US010479536B2

(12) United States Patent
Bell

(10) Patent No.: US 10,479,536 B2
(45) Date of Patent: Nov. 19, 2019

(54) SYSTEM, METHODS AND APPARATUS FOR URINE COLLECTION AND STORAGE

(71) Applicant: Portland Outdoors, LLC, Evergreen, AL (US)

(72) Inventor: Don Bell, Furman, AL (US)

(73) Assignee: PORTLAND OUTDOORS, LLC, Evergreen, AL (US)

( * ) Notice: Subject to any disclaimer, the term of this patent is extended or adjusted under 35 U.S.C. 154(b) by 705 days.

(21) Appl. No.: 14/028,762

(22) Filed: Sep. 17, 2013

(65) Prior Publication Data

US 2014/0075886 A1 Mar. 20, 2014

Related U.S. Application Data

(60) Provisional application No. 61/701,842, filed on Sep. 17, 2012.

(51) Int. Cl.
*B65B 3/18* (2006.01)
*B65B 31/04* (2006.01)

(52) U.S. Cl.
CPC ..... *B65B 3/18* (2013.01); *B65B 31/042* (2013.01)

(58) Field of Classification Search
CPC ..... B65B 31/04; B65B 31/042; B65B 3/18; B65B 31/06; B65B 3/003; A01K 23/00; A01K 23/005; B67C 3/10
USPC ..... 53/510
See application file for complete search history.

(56) References Cited

U.S. PATENT DOCUMENTS 2,193,059 A * 3/1940 Chapman ..... B65B 3/003 141/275
2,415,419 A * 2/1947 Cozzoli ..... B65B 3/003 141/278
2,859,956 A * 11/1958 Meriam ..... A61B 5/208 177/4
3,212,537 A * 10/1965 Hinxlage ..... B67C 3/10 141/39
3,228,444 A * 1/1966 Weber ..... A61F 5/44 383/36
3,270,714 A * 9/1966 Gandier ..... A01K 23/00 119/867
3,356,510 A * 12/1967 Barnby ..... B65B 55/02 141/11
3,376,688 A * 4/1968 Takacs ..... B65B 3/003 141/11

(Continued)

*Primary Examiner* — Nathaniel C Chukwurah
*Assistant Examiner* — Lucas E. A. Palmer
(74) *Attorney, Agent, or Firm* — Clark & Brody

(57) ABSTRACT

A method and apparatus for collecting and storing urine comprises a collecting funnel and collection tank. The funnel has a valve that opens flow of urine begins and closes once the flow stops based on a flow sensor. The flow time of urine is recorded and used to regulate the evacuation and inert gas filling of a head space in the collection container once the urine is collected. The inert gas protects the urine from oxidation so that degradation is minimized while in the collection container. A similar control can be exercised when a bottle is filled with urine from the collection container, wherein head space in the bottle is filled with inert gas for oxidation protection to form a finished package. The head space of finished package can be evacuated to minimize degradation of the urine once the urine is accessed an initial time in the finished package.

10 Claims, 2 Drawing Sheets

(56) References Cited

U.S. PATENT DOCUMENTS 3,556,174 A * 1/1971 Gibble ..... B65B 31/00 141/69
3,804,133 A * 4/1974 Copping ..... B67C 3/10 141/37
3,817,239 A * 6/1974 Kuntz ..... A61B 10/00 600/575
3,899,862 A * 8/1975 Muys ..... B65B 55/10 422/37
4,347,695 A * 9/1982 Zobel ..... B65B 31/006 141/11
4,476,879 A * 10/1984 Jackson ..... A61F 5/453 119/869
4,697,462 A * 10/1987 Daube, Jr. ..... G01N 1/18 55/528
4,732,037 A * 3/1988 Daube, Jr. ..... G01N 1/18 73/170.17
4,865,811 A * 9/1989 Newton ..... G01N 35/085 422/81
4,891,993 A * 1/1990 Barker ..... A61B 5/14507 73/861.08
4,941,310 A * 7/1990 Kristen ..... B65B 31/046 53/434
4,943,416 A * 7/1990 Kikuchi ..... G01N 35/00029 422/63
4,977,723 A * 12/1990 Dubrulle ..... B65B 31/006 141/64
4,981,144 A * 1/1991 Carels, Jr. ..... A61B 5/14507 141/237
4,987,726 A * 1/1991 Petho ..... B67C 7/0073 53/281
5,031,673 A * 7/1991 Clusserath ..... B65B 55/10 141/11
5,057,211 A * 10/1991 Baummer ..... B03B 5/02 209/448
5,073,500 A * 12/1991 Saito ..... A61B 5/14507 4/300
5,159,799 A * 11/1992 Rising ..... B65B 3/006 53/433
5,380,289 A * 1/1995 Hemstreet ..... A61B 10/007 422/535
5,423,792 A * 6/1995 Oxley ..... A61B 10/007 128/DIG. 24
5,429,803 A * 7/1995 Guirguis ..... A61B 10/007 422/419
5,522,439 A * 6/1996 Hakansson ..... B65B 3/30 141/177
5,565,111 A * 10/1996 Newman ..... A01M 31/008 119/161
5,596,948 A * 1/1997 Ritchie ..... A01K 1/031 119/417
5,625,911 A * 5/1997 Nakayama ..... A61B 10/007 4/661
5,672,342 A 9/1997 Bell
5,714,696 A * 2/1998 Yeamans ..... G01N 1/14 73/863.84
5,772,606 A * 6/1998 Ashibe ..... G01N 33/493 600/573
5,792,132 A * 8/1998 Garcia ..... A61F 5/451 604/329
6,030,608 A * 2/2000 Hoyes ..... A01K 1/0152 424/76.1
6,112,780 A * 9/2000 Meheen ..... B67C 3/10 141/40
6,220,310 B1 * 4/2001 Emmer ..... B67C 3/10 141/11
6,340,036 B1 * 1/2002 Toyoizumi ..... B65B 1/12 141/275
6,609,871 B2 * 8/2003 Pfeiffer ..... B65G 53/18 406/89
6,740,066 B2 * 5/2004 Wolff ..... A61B 5/20 604/319
7,021,034 B2 * 4/2006 Higer ..... B65B 31/00 53/510
7,076,929 B2 * 7/2006 Patterson ..... B65B 31/06 53/405
7,131,250 B2 * 11/2006 Kahn ..... B65B 31/046 53/374.9
RE39,457 E * 1/2007 Guirguis ..... A61B 10/007 422/419
7,303,665 B1 * 12/2007 Claudio-Alvarado ..... A01K 63/045 119/259
7,762,596 B1 * 7/2010 Gaydos ..... A01K 23/005 119/161
8,561,574 B2 * 10/2013 Tchekneva ..... A01K 1/031 119/417
8,597,207 B1 * 12/2013 Perry ..... A61F 5/455 600/574
2001/0037098 A1 * 11/2001 Snyder ..... A61F 5/4553 604/331
2001/0045242 A1 * 11/2001 Clusserath ..... B67C 3/286 141/144
2002/0014276 A1 * 2/2002 Clusserath ..... B67C 3/065 141/40
2002/0083682 A1 * 7/2002 Edwards ..... B65B 55/025 53/426
2002/0094566 A1 * 7/2002 Tubbs ..... B01J 20/281 210/198.2
2003/0164051 A1 * 9/2003 Kunimune ..... A61B 10/007 73/863.23
2004/0207530 A1 * 10/2004 Nielsen ..... A61F 13/42 340/604
2005/0011580 A1 * 1/2005 Ziegler ..... B67C 3/222 141/2
2005/0061393 A1 * 3/2005 Luis ..... C12H 1/12 141/65
2005/0133536 A1 * 6/2005 Kelsey ..... B65B 1/16 222/181.1
2005/0241726 A1 * 11/2005 Clusserath ..... B67C 3/04 141/144
2006/0259195 A1 * 11/2006 Eliuk ..... A61J 1/20 700/245
2007/0161779 A1 * 7/2007 Vella ..... C07J 75/00 530/326
2008/0091085 A1 * 4/2008 Urushihata ..... A61B 10/0045 600/300
2008/0228106 A1 * 9/2008 Forte ..... A61F 5/4556 600/575
2009/0126252 A1 * 5/2009 Lowe ..... A01N 63/02 43/1
2009/0233376 A1 * 9/2009 Hendrickson ..... G01N 31/22 436/170
2009/0266720 A1 * 10/2009 Richards ..... B65B 31/06 206/213.1
2010/0043917 A1 * 2/2010 Kitchener ..... B65B 31/047 141/65
2010/0065150 A1 * 3/2010 Conforti ..... B67C 3/10 141/100
2010/0071802 A1 * 3/2010 Clusserath ..... B65B 39/001 141/44
2010/0132831 A1 * 6/2010 Waroux ..... B65B 31/042 141/66
2010/0247372 A1 * 9/2010 Pohl ..... A01M 1/2061 422/4
2011/0072887 A1 * 3/2011 Oki ..... B03C 3/014 73/28.02
2011/0097250 A1 * 4/2011 Yong ..... A61B 10/0045 422/547
2011/0098590 A1 * 4/2011 Garbutt ..... A61B 5/0059 600/532
2011/0126939 A1 * 6/2011 Luis ..... C12H 1/16 141/65
2011/0239953 A1 * 10/2011 Tchekneva ..... A01K 1/031 119/417
2011/0290374 A1 * 12/2011 Clusserath ..... B67C 3/06 141/67

(56) References Cited

U.S. PATENT DOCUMENTS

| | | | | |
|---|---|---|---|---|
| 2012/0137758 | A1* | 6/2012 | Mizumachi | A01K 1/031 73/64.56 |
| 2012/0252709 | A1* | 10/2012 | Felts | A61M 5/3129 508/100 |
| 2012/0266567 | A1* | 10/2012 | Haesendonckx | B65B 3/022 53/456 |
| 2012/0279180 | A1* | 11/2012 | Crawford | B65B 57/00 53/432 |
| 2013/0105041 | A1* | 5/2013 | Krulitsch | B67C 3/26 141/4 |
| 2013/0228501 | A1* | 9/2013 | Lefebvre | B01D 15/206 210/198.2 |
| 2013/0307197 | A1* | 11/2013 | Haesendonckx | B65B 5/02 264/524 |
| 2014/0213934 | A1* | 7/2014 | Ellis | A61B 10/0096 600/575 |

* cited by examiner

SYSTEM, METHODS AND APPARATUS FOR URINE COLLECTION AND STORAGE

This application claims priority under 35 USC 119(e) based on provisional application No. 61/701,842, filed on Sep. 17, 2012.

FIELD OF THE INVENTION

The invention relates to a device and method for collecting and storing of urine, particularly deer urine, for hunting purposes, wherein the urine is collected and packaged in an oxygen free environment to reduce degradation of the urine during the collection and packaging process as well as during its storage.

BACKGROUND ART

It is well known to collect deer urine to use as an attractant in hunting. Typically, the collection of urine is done from a number of deer at a time.

In another mode and as disclosed in U.S. Pat. No. 5,672,342 to Bell, urine is collected from one single individual animal at a time.

The Bell patent addresses and solves a quality issue of using multiple deer urine for attractant purposes. The use of one deer's urine is better as an attractant to draw deer in close to a person than that of blended urine collected from numerous deer over a period of given time.

However, neither of these methods or processes addresses the problem of ammoniating of the urine as a result of the urine being exposed to light, heat, and oxygen. Oxygen, being the main cause, along with light, and heat contaminate and break down urine causing it to ammoniate, which then creates a strong smell and a darkening of the urine during the collection, storage, bottling into a package, and usage of the package by a consumer. Whereas, light and heat are major factors in the contamination of urine resulting in ammonia, oxygen is also a larger factor.

The result of urine exposed to oxygen is a much lesser quality product, and this results in lesser success when using oxygen-exposed urine to draw or lure an animal in close. This is due to the fact, that in the natural setting of the wild outdoors when an animal voids urine, the ammonia process begins due to immediate exposure to oxygen. This tells a second animal that smells the urine how fresh the scent is and how long since the first animal was there.

The invention addresses the problem of urine quality loss involving the issues of contamination of urine caused by oxygen, light, and heat during the collection, storage, and the bottling into a finished package and the repeated usage of the opening and closing by the end user of the finished package.

SUMMARY OF THE INVENTION

The invention relates to the collection and packaging of urine, and particularly deer urine, in a way that the exposure of the urine during the collection and packaging thereof to oxygen is minimized.

In one aspect, the invention provides a finished package of urine wherein the urine is in a container having an air tight lid and a head space between the surface of the urine in the container and the lid. The head space is filled with an inert gas so that the urine is not in contact with oxygen during its storage time in the container and does not ammoniate.

Another aspect of the invention is an overall system and process wherein the urine is collected under cover of inert gas, is supplied to a bottling machine under an inert gas cover, and is bottled under inert gas cover to produce the finished package with an inert gas head space.

As part of the overall system and process, a collection step and apparatus is employed that collects urine from a deer while protecting the urine from oxygen contact.

Another part of the overall system and process is a bottling apparatus and step, wherein the urine collected from the animal fills bottles without being in contact with oxygen. The bottling apparatus and step produce the finished package containing the urine and inert gas head space.

Yet another part of the overall system is the ability to minimize the contact of the urine with oxygen once a user accesses the urine in the finished packaging. In this aspect, the container of the finished package can be coupled with a vacuum plug and vacuum pump. Once the finished package container is opened and the urine is used, the plug is secured to the open end of the container and the vacuum pump cooperates with the plug to evacuate the head space in the container and remove any oxygen therein. The urine can be stored in this oxygen-free state until it needs to be used again. The procedure is repeated once more urine is removed from the container.

As an alternative, the urine in the container of the finished packaging can be transferred to another container that fits the vacuum plug if the finished packaging container opening is not adapted to fit the vacuum plug.

Referring to the collection aspect of the invention, the urine is supplied into a closed collection container, preferably a closed and chilled container, for the collection of urine. The collection container is constructed so that light cannot enter its interior through the container walls.

The closed collection container, if chilled, is kept at a chilled temperature and a funnel is provided, also chilled, above the collection container and below the source of the urine. The funnel has a sensor and valve, wherein the valve opens upon flow of the voided urine into the funnel as determined by the sensor. This flow triggers the valve to open just long enough for the voided urine to be collected in the chilled collection container beneath the chilled funnel. The valve is intended to be air tight so that when it closes, oxygen cannot enter into the collection container. Once the sensor determines the end of the urine flow, the valve is closed.

Upon the sensor being trigger by the voided urine, the period of time the urine is flowing into the collection container is tracked or monitored. When the flow of urine stops, the sensor can trigger, if so desired, for the same time or similar period of time of sensed urine flow, an introduction of inert gas into the collection container. This is accomplished by supply of an inert gas (chilled or unchilled) to the collection container. The inert gas, e.g., carbon dioxide, nitrogen, argon, or the like, being heavier than oxygen creates a protective barrier on top of the urine as well as purging any oxygen from the collection container. Thus, the urine is protected from light, heat and oxygen and may be stored for an indefinite period of time without loss of quality at time of collection. Again, the collection container contains urine that is not damaged from light, heat and oxygen.

Besides providing an innovative way and apparatus to collect the urine while minimizing damage from light, heat, and oxygen, the invention also improves the packaging of the stored urine, Currently, the method and process of bottling and packaging of the urine from the collection container causes further exposure to light, heat and oxygen. In addition to the problem of exposing the urine to light, heat and oxygen during the bottling and packaging, there is the additional problem of oxygen being left in the "head space" of the finished package. Head space is the unfilled portion left in the finished package, which would contain oxygen. The oxygen left in the "head space" of the finished package continues the breakdown of the quality of the urine contained in the packaging that is waiting to be used by a user of the urine.

Once the urine is collected in the collection container, a process and apparatus is provided whereby the stored urine protected by the collection method described above is put into a finished package, which would be designed for a purchaser of urine for use in hunting, (herein called the finished package). As part of the filling of the finished package, air in the head space is removed by filling with containers of the finished package with inert gas (chilled or unchilled) to function as a protective layer over the urine contained in the finished package. More particularly, the urine is placed into the finished package and the "head space" in the finished package itself is filled with an inert gas to insure quality until the finished package is used by the end user the consumer.

The invention has yet a third aspect to it to address yet another problem concerning collecting and storing of urine. This problem is caused by the actual usage of the finished package at a future date. The very action of opening and using urine from the finished package itself and its repeated act of usage allows oxygen damage to occur. With each usage, there becomes more oxygen in the "head space" of the finished package allowing damage to take place.

This problem is solved by providing a means to evacuate the head space, either in the finished package container itself or another container that receives the urine originally found in the finished packaging container. This means includes, in one embodiment, a vacuum plug and vacuum pump. These two are used to evacuate the head space of the container holding the urine so that the head space is oxygen free during storage. The evacuation of the head space can be done each time the urine is accessed for use.

This method and process insures a consistent quality of urine from the time an animal voids the urine all the way through the collection, storage, bottling of the finished package and the repeated usage of the finished package.

While the invention is intended primarily to collect and store deer urine from one animal, deer urine from a number of deer, it can also be employed to collect the urine of another animal such as a bear, elk, moose, or the like.

DESCRIPTION OF THE INVENTION

Figure 1:
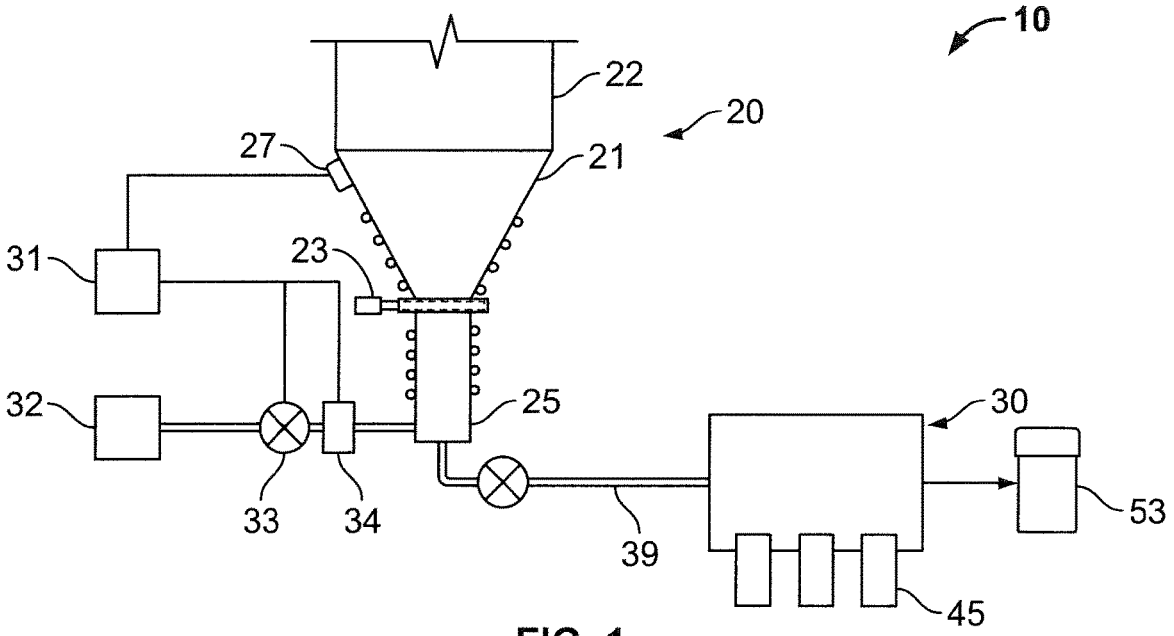
FIG. 1 is a schematic drawing of one embodiment of the apparatus of the invention showing a system for collection of urine.
Figure 2:
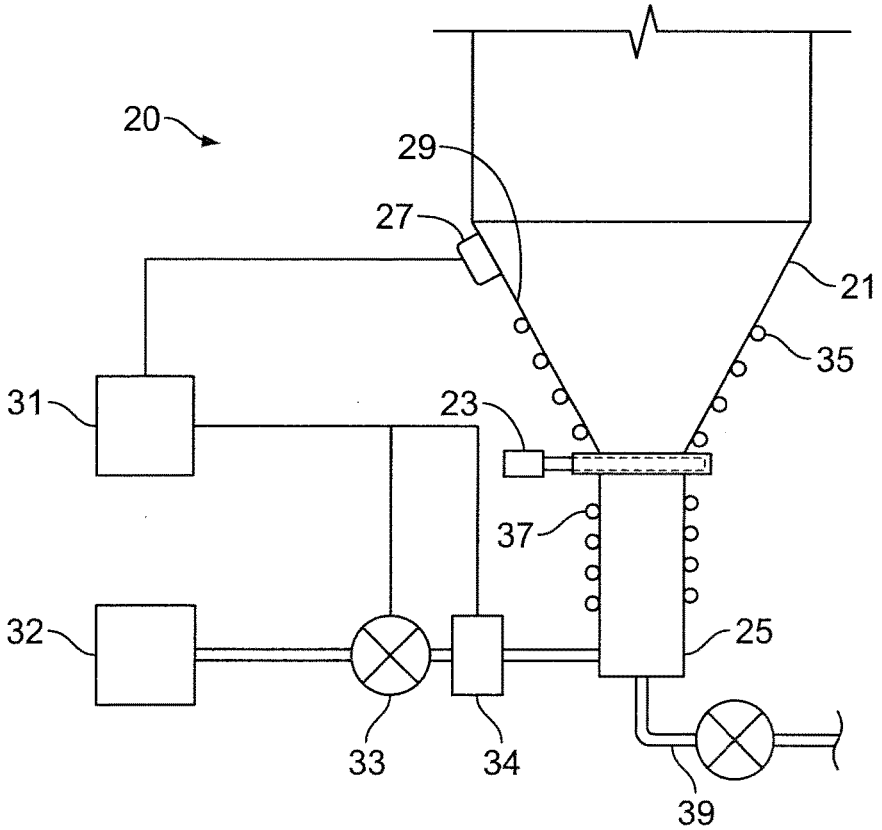
FIG. 2 is a schematic drawing showing a part of the apparatus of FIG. 1.

One embodiment of the invention is depicted in FIGS. 1 and 2. The apparatus aspect of the invention entails a system 10 for the collection of urine in such a way that the urine is minimally exposed to oxygen until it is accessed by a user in its finished package. The system 10 includes a urine collection apparatus 20 and a bottling apparatus 30. The urine collection apparatus basically collects the urine from one or more animals like deer from a stall in a way that the urine is kept free from oxygen once collected. The urine collected in the apparatus 20 can then be supplied to the bottling apparatus 30, wherein the urine is bottled in such a way the urine is shielded from oxygen during the bottling process and packaged under an inert gas atmosphere until the finished package is opened by a user.

Still referring to FIGS. 1 and 2, the collection apparatus 20 includes a funnel 21, that is disposed beneath a typical stall 22 used to collect urine from an animal. Since these stalls are well known in the art, a further description is not deemed necessary for understanding of the invention.

Included with the funnel is a valve 23 and a collection container 25. The valve 23 controls the flow of urine from the stall 22 to the collection container 25. While any valve can be used, a preferred valve is a gate valve. The valve is also one that provides an air tight seal to the collection container 25.

The apparatus 20 also includes a sensor 27, which is designed to sense the beginning and end of the flow of urine into the funnel, preferably a contact sensor that detects contact of urine with the funnel wall 29. This can be any type of sensor that would detect contact with the wall by a material such as urine. These contact sensors are well known in the art so that a further description of them is not needed for understanding of the invention. Of course other sensors may be employed that will detect the flow of urine into the funnel, e.g., ones using light.

The sensor 27 is linked to a controller 31, with the controller 31 designed to control the flow of an inert gas source, designated as 32 in FIG. 1, through valve 33 and pressure regulator 34 into the collection container 25. The controller 31 also includes a timer that measures the time of urine flow into the collection container by the sensor 27 first detecting urine flowing into the funnel 21 and then sensing the termination of the urine flow, hereinafter the urine flow time. The inert gas is also supplied to the collection container with the valve 23 closed and prior to its receipt of urine. This means that the urine enters an inert gas filled collection chamber and does not see oxygen as it enters the collection container 25.

The collection container 25 and funnel are preferably cooled or chilled to around 60 degrees F. so that the urine when contacting the funnel wall 29 and entering the collection container 25 is chilled. The cooling is shown as coils 35 on the funnel and coils 37 on the collection container, wherein a cooling fluid (not shown) is supplied to the coils 35 and 37 for cooling purposes. Of course, other known ways to chill the funnel and collection container can be employed.

The collection container can also be equipped with a discharge line 39 that is in communication with the bottling apparatus 30 with its use described hereinafter.

The assembly of the collection container, the funnel, the controller, sensor, inert gas supply, and valve are considered means for collecting and storing urine in an oxygen free atmosphere to minimize the degradation of the urine during the collection and storage thereof. The supply of the inert gas is essential for filling the collection container prior to its receipt of urine and then can be optionally employed to provide additional inert gas once the flow of urine ceases and the valve 23 closes.

In the method aspect of the urine collection, the valve 23 is in its closed state and the collection container is filled with an inert gas at a pressure around atmospheric. Once urine begins to fall into the funnel 21 and contact the funnel wall 29, the sensor 27 detects the urine and signals the controller 31 to open the valve 23. Because the inert gas is heavier than air, it occupies the volume of the collection container 25 and the urine passes through the inert gas and towards the bottom of the collection container 25.

Once the sensor 27 determines that no more urine is flowing into the funnel 21, the controller 31 closes the valve 23 and the urine is held in the collection container under cover of the inert gas, thus not in the presence of oxygen.

Once the valve 23 is closed, the controller 31 can, optionally, supply additional inert gas to the collection container to ensure that it only contains inert gas. This is an optional step because once the urine is funneled into the collection container 25; the inert gas therein is displaced out through the valve opening during the filling step. Therefore, the inert gas should still occupy the volume of the collection container 25 remaining after urine is collected therein. The supply of the inert gas to the collection container 25 assures the oxygen free state of the urine while in the collection chamber.

The timer of the controller 31 is used in conjunction with the supply of inert gas after collection of urine and closing of the valve 23. That is, the timer tracks the time that the valve 23 is open and then provides a flow of inert gas from source 32 via opening of the inert gas valve 33 that matches or approximates the time that the valve 23 is open. Of course, the controller 31 could be designed to supply inert gas to the collection container 25 for a period longer than the valve 23 opening time, if so desired, to provide further assurance of an absence of oxygen into the collection chamber.

Once a quantity of urine is collected, it can be sent to the bottling apparatus 30 via the discharge line 39. Prior to sending the collected urine to the bottling apparatus 30, the supply line is purged of any air with inert gas. This assures that the travel of the urine in the oxygen-free state in the collection container 25 does not encounter any oxygen on the way to the bottling apparatus 30. This purging can be done in any conventional way and further details of this step are not deemed necessary for understanding of the invention.

Turning now to FIGS. 1 and 3*a*-*d*, the bottling apparatus is similar to a wine bottling apparatus in that empty bottles are conveyed through the apparatus, filled, and capped. Thus, the transport and handling of the bottles is deemed conventional and a further description is not needed for understanding of the invention.

One difference in the bottling apparatus and method of filling is that the apparatus 30 includes a feed line for inert gas and a feed line for urine. This aspect of the apparatus is shown schematically in FIG. 3*a*-3*d* with the inert gas feed line designated as 41 and the urine feed line designated as 43. The bottle to be filled with the urine is designated by reference numeral 45.

Figure 3A:
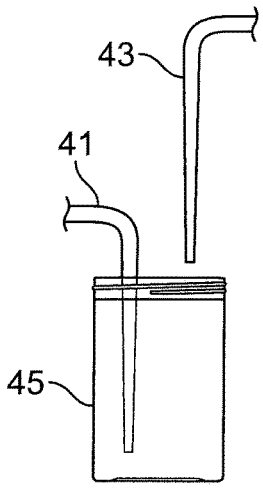
FIGS. 3(*a*) to 3(*d*) are schematic drawings showing a bottling apparatus for filling bottles with urine with different bottling steps illustrated.
Figure 3B:
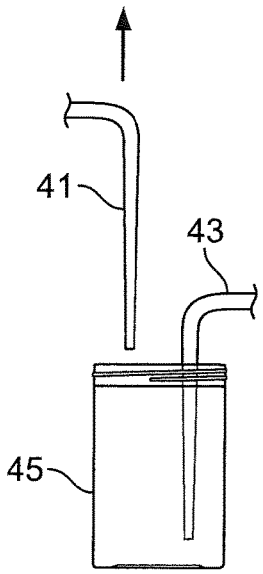
Figure 3C:
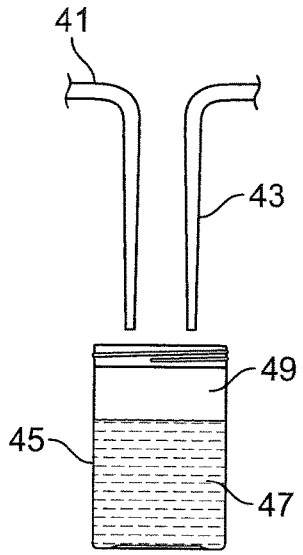

In FIG. 3*a*, the inert gas feed line 41 supplies inert gas to the bottle 45. Enough inert gas is fed into the bottle 45 to at least fill it. Since the inert gas is heavier than air, it will displace the oxygen in the bottle 45. In FIG. 3*b*, the inert gas feed line 41 is removed from the bottle and the urine feed line 43 is lowered so that its open end is below the level of the inert gas residing in the bottle. The urine is then pumped into the bottle 45, providing a volume 47 as shown in FIG. 3*c*. Above the level of urine is a head space 49, which is the inert gas.

Figure 3D:
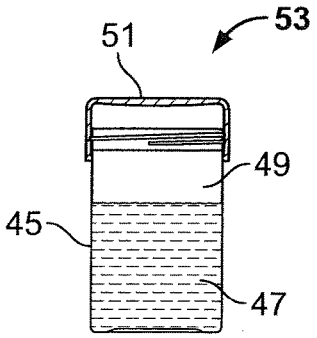

In FIG. 3*d*, the bottling apparatus, then attaches the cap 51 to the bottle 45 such that a finished package 53 is provided with an amount of urine and inert gas. With the cap 51 in place, there is no oxygen in the bottle 45 so that the urine will not ammoniate over time (change to a brown color from its natural yellow color). Thus, the urine is of high quality for the end user, particularly when collecting deer urine. The feed lines of the bottling apparatus are considered means for filling the bottles with urine and providing the inert gas head space in the bottle once the bottle is capped. Of course, other ways could be employed to fill the bottles with inert gas and then urine than the feed lines. The bottles could be moved with respect to stationary feed lines.

Figure 4A:
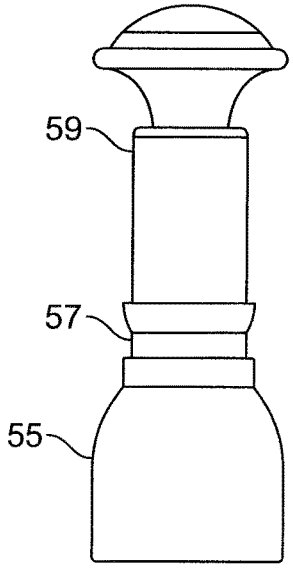
FIGS. 4(*a*) and 4(*b*) show two different types of storage containers for the urine using a bottle and vacuum pump.
Figure 4B:
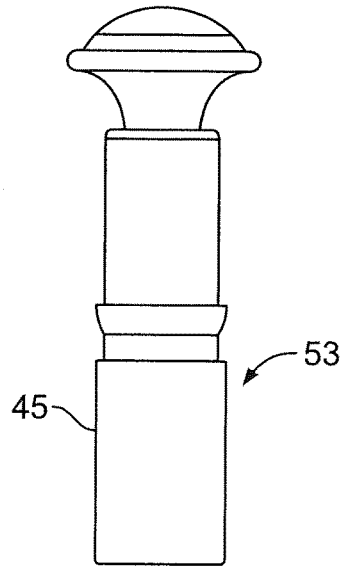

The invention also entails a system to preserve as much as possible the oxygen free state of the urine in the finished package 53. With reference to FIGS. 4*a* and 4*b*, an assembly is shown of a container 55, a vacuum plug 57, and a vacuum pump 59. The plug 57 and pump 59 are similar to those used in the wine industry to evacuate a wine bottle air space after it has been opened. In FIG. 4*a*, the container is different from the bottle 45 produced by the bottling apparatus 30. This situation may occur if the bottle 45 does not have the right bottle opening to mate with a standard vacuum plug. In this instance, the user of the finished package, after opening of the bottle 45 and using the urine for its intended purpose, would transfer the urine into the container 55. Once the urine is in the container 55, the plug 57 and pump 59 would be employed to remove the air in the container 55 to keep the urine in an oxygen free state.

In FIG. 4*b*, the opening of the bottle 45 of the finished package 53 is configured so that it can directly mate with the vacuum plug 57. In this mode, the user, after opening the bottle 45 and using an amount of urine can just plug the bottle 45 with the vacuum plug and evacuate the head space in the bottle to remove air and create an oxygen free head space. In this embodiment, the user of the finished package avoids the transfer step of putting the urine from the finished package 53 into another container 55. In either case though, the evacuation of the container 55 or bottle 45 enhances the life of the urine by removing oxygen.

While a typical vacuum plug or rubber stopper and vacuum pump are preferred, any means that would be able to remove air (evacuate it) in a container holding an amount of urine can be employed in conjunction with the finished package.

The invention claimed is:

1. A system for collecting and storing animal urine comprises, a funnel, a valve, and a collection container, the valve positioned between a discharge end of the funnel and an inlet end of the collection container, the valve controlling flow of the animal urine entering the funnel into the collection container, the collection container having a side portion and a bottom portion with an outlet therein, the collection container in communication with a discharge end of the funnel, a sensor positioned with respect to the funnel to detect a presence and absence of the animal urine flowing into the funnel, and means for opening the valve when urine flow begins in the funnel and closing the valve when the urine flow in the funnel stops, means for determining a period of time of urine flow at least into the funnel, and means for removing air in the collection container at least prior to opening of the valve and entry of urine into the collection container, and optionally after filling supplying inert gas to the collection container containing the urine.

2. The apparatus of claim 1, wherein one or more of the funnel and the collection container are chilled.

3. The apparatus of claim 2, wherein the funnel is chilled.

4. The apparatus of claim 3, wherein the collection container is chilled.

5. The apparatus of claim 2, wherein the collection container is chilled.

6. The apparatus of claim 1, wherein the valve is a gate valve and a controller is the means for opening and closing the gate valve, the controller responding to a signal from the sensor that indicates flow of the animal urine for gate valve opening or an absence of flow of the animal urine for gate valve closing.

7. The apparatus of claim 1, wherein the means for removing provides a supply of inert gas to the collection container.

8. A system for producing a plurality of bottles of animal urine having a head space consisting of inert gas comprising:

an apparatus for collecting and storing animal urine comprising:

a funnel, a valve, and a collection container, the valve positioned between a discharge end of the funnel and an inlet end of the collection container, the valve controlling flow of the animal urine entering the funnel into the collection container, the collection container having a side portion and a bottom portion with an outlet in the bottom portion, the collection container in communication with a discharge end of the funnel, a sensor positioned with respect to the funnel to detect a presence and absence of the animal urine flowing into the funnel, and means for opening the valve when the animal urine flow begins in the funnel and closing the valve when the animal urine flow stops in the funnel, means for determining a period of time of animal urine flow into the funnel, and means for removing air in the collection container at least prior to opening of the valve and entry of the animal urine into the collection container, and, optionally after filling, by supplying inert gas to the collection container containing the animal urine; and a bottling apparatus in communication with the outlet of the collection container for filling and capping a plurality bottles in a continuous fashion, the improvement comprising a means to first supply inert gas to each of the plurality of bottles, each bottle being open to receive the inert gas, a means to subsequently supply animal urine from the collection container to each of the plurality of bottles, and means for applying a cap to each of the plurality of bottles, wherein each capped bottle includes a quantity of the animal urine and a head space above a surface of the animal urine that consists of an inert gas.

9. The system of claim 8, wherein each of the plurality of bottles has a threaded open end to receive the cap, the cap removably attachable to the open end.

10. The system of claim 8 further comprising an assembly for preserving an oxygen-free state of a bottle of animal urine containing a head space of inert gas comprising a portable vacuum pump and plug assembly for evacuating the head space from the bottle after being opened or a second container to remove any oxygen that is or may be present in the head space, the plug configured to attach to an opening of the bottle or the second container for evacuation.

* * * * *